US006164986A

United States Patent [19]

Frantz et al.

[11] Patent Number: 6,164,986

[45] Date of Patent: Dec. 26, 2000

[54] ELECTRICAL CONNECTOR ASSEMBLY HAVING A GROUNDING CLIP

[75] Inventors: Robert H. Frantz, Newville; Keith S. Koegel, Plainfield; Robert Neil Whiteman, Jr., Middletown, all of Pa.

[73] Assignee: The Whitaker Corporation, Wilmington, Del.

[21] Appl. No.: 09/231,249

[22] Filed: Jan. 15, 1999

[51] Int. Cl.[7] ..... H01R 13/648; H01R 9/03

[52] U.S. Cl. ..... 439/98; 439/610

[58] Field of Search ..... 439/98, 95, 610, 439/578, 709, 701, 469; 174/35 C, 36

[56] References Cited

U.S. PATENT DOCUMENTS

| | | | |
|---|---|---|---|
| 4,029,384 | 6/1977 | Reinwall et al. | 339/98 |
| 4,512,619 | 4/1985 | Dechelette | 439/276 |
| 5,083,929 | 1/1992 | Dalton | 439/98 |
| 5,199,903 | 4/1993 | Asick et al. | 439/610 |
| 5,314,357 | 5/1994 | Weidler et al. | 439/701 |
| 5,443,403 | 8/1995 | Weidler et al. | 439/701 |
| 5,636,306 | 6/1997 | Mock et al. | 385/101 |
| 5,718,607 | 2/1998 | Murphy et al. | 439/610 |
| 5,725,387 | 3/1998 | O'Sullivan et al. | 439/98 |
| 5,814,769 | 9/1998 | Karlstrom et al. | 174/117 F |
| 5,913,174 | 4/1999 | Casarez et al. | 455/557 |

OTHER PUBLICATIONS

Drawings from Case No. 17338, Serial No. 09/108,366, Filed Jun. 30, 1998. 3 sheets.

Abstract from Case No. 17338, Serial No. 09/108,366, Filed Jun. 30, 1998.

*Primary Examiner*—Brian Sircus
*Assistant Examiner*—Chandrika Prasad
*Attorney, Agent, or Firm*—Michael Aronoff

[57] ABSTRACT

The invention is directed to an electrical connector assembly having a connector housing for terminating wires from a shielded cable. The cable has shielding therearound. A grounding clip commons the shielding from the cable. The ground clip has an opening through which the cable extends with tabs therein to provide electrical connection to the shielding of the cable and electrical engagement tabs to provide engagement with an adjacent structure. An overmolded housing is molded over the cable and the grounding clip, wherein the electrical engagement tabs extend above and below the overmolded housing.

26 Claims, 5 Drawing Sheets

ELECTRICAL CONNECTOR ASSEMBLY HAVING A GROUNDING CLIP

FIELD OF THE INVENTION

The invention is directed towards an electrical connector to be mounted in a shielded enclosure. The invention is further directed to the grounding clip used to shield and seal an opening in the enclosure.

BACKGROUND OF THE INVENTION

Electrical motors have wires extending from the housing which need to be connected to both power cables and signal cables in order to control the operation of the motor. Often these wires are terminated directly to cable assemblies which extend from the housing of the motor. In the event of failure of the electrical motor, the motor and all the above cable assemblies attached thereto must be removed and scrapped.

It would be an advantage to provide cable assemblies which are separable from the electrical motor so that, in the event of motor failure, the cable assemblies can be saved. It would, therefore, be necessary to provide shielding of the cables and shielding of the electrical connector assembly.

SUMMARY OF THE INVENTION

The invention is directed to a grounding clip for an opening in an enclosure. The grounding clip comprises a conductive member for providing an electrical connection between shielding from a shielded cable and a conductive portion of an adjacent article. The conductive member has a body including first and second sections. The first section has at least one opening through which the cable is received. The opening engages the shielding to provide an electrical connection between the conductive member and the shielding. The second section is adapted to provide electrical engagement with a conductive portion of an adjacent article or structure.

The invention is further directed to a grounding clip having a conductive member comprising two halves to be secured together around a shielded cable. Each half includes a planar first body section. The two halves form an opening therethrough with a cable engaging section to engage the shielding from the cable. Each of the halves has a second or electrical engagement section disposed along one side thereof to provide electrical engagement along a top and a bottom of the conductive member or grounding clip.

The invention is also directed to an electrical connector assembly comprising a connector housing for terminating wires from a shielded cable. A grounding clip electrically connects the shielding from the shielded cable to a conductive portion of an adjacent article. A planar section of the grounding clip has an opening through which the cable is received with tabs therein to provide electrical connection to the shielding of the shielded cable and a second section having grounding or electrical engagement tabs to provide electrical connection or engagement with a conductive portion of an adjacent structure, such as, for example, an electrical connector, or a conductive shroud of an electrical motor.

Additionally, the invention is directed to an electrical connector assembly comprising a connector housing for terminating wires from a shielded cable. A cable has shielding therearound. A grounding clip is in electrical connection with the shielding from the cable. The grounding clip has an opening through which the cable extends with tabs therein to provide electrical connection to the shielding of the cable and electrical connection tabs to provide engagement with an adjacent structure. An overmolded housing is molded over the cable and the grounding clip, wherein the electrical connection tabs or conductive portions extend above and below the overmolded housing.

BRIEF DESCRIPTION OF THE DRAWINGS

An embodiment of the invention will now be described with reference to the accompanying drawings, in which.

DETAILED DESCRIPTION OF EMBODIMENTS OF THE INVENTION

Co-pending patent application Ser. No. 09/108,366, now abandoned, which is hereby incorporated by reference, discloses an electrical connector for a motor having a header housing mounted on the motor and a conductive shroud mounted thereround to provide shielding of the enclosed connectors. The header housing mates with mating connectors which provide the power and signal to the electrical motor. The opening into the conductive shroud is sealed using a conductive grommet.

Figure 1:
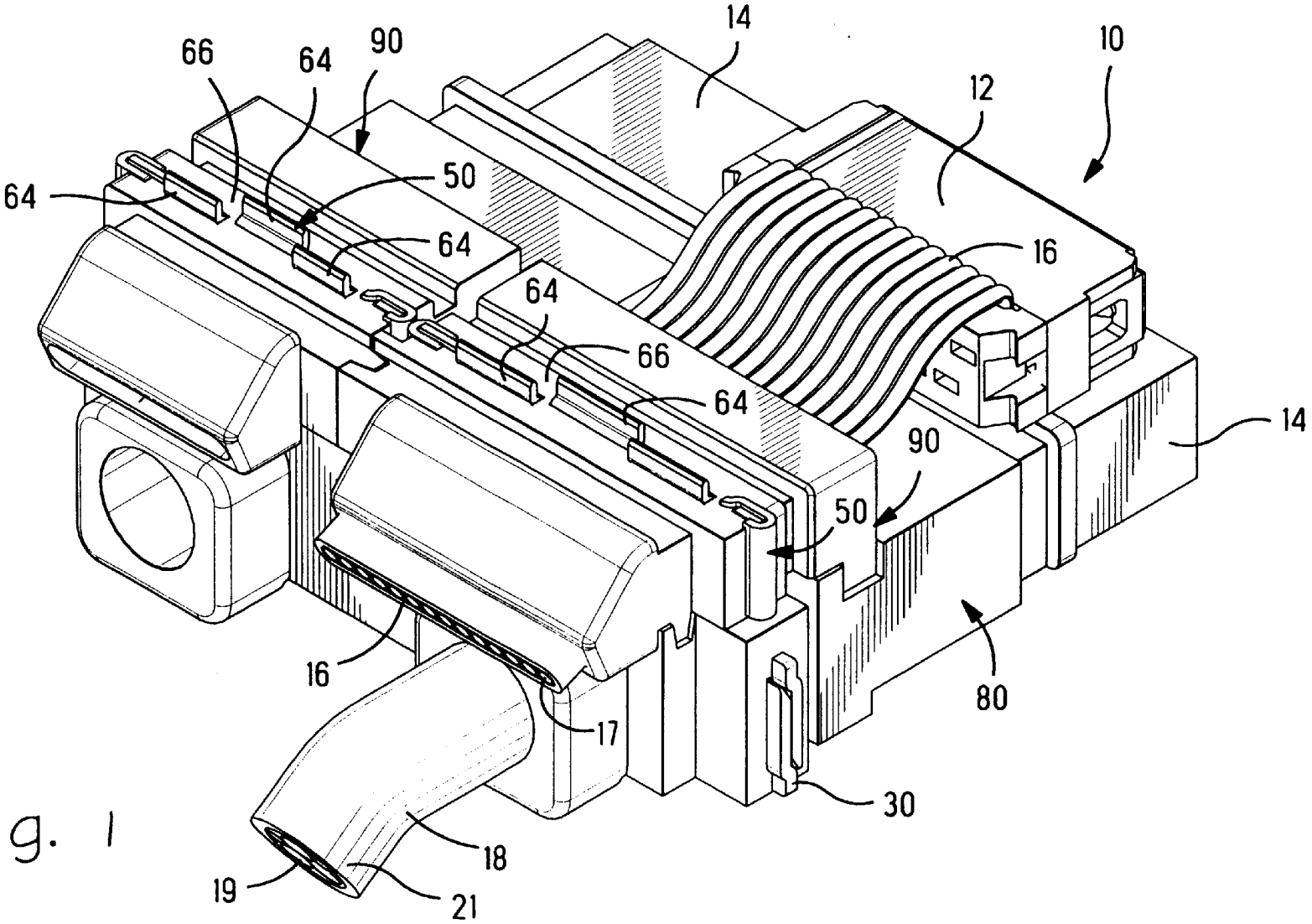
FIG. 1 is an isometric view of the electrical connector assembly of the present invention.
Figure 3:
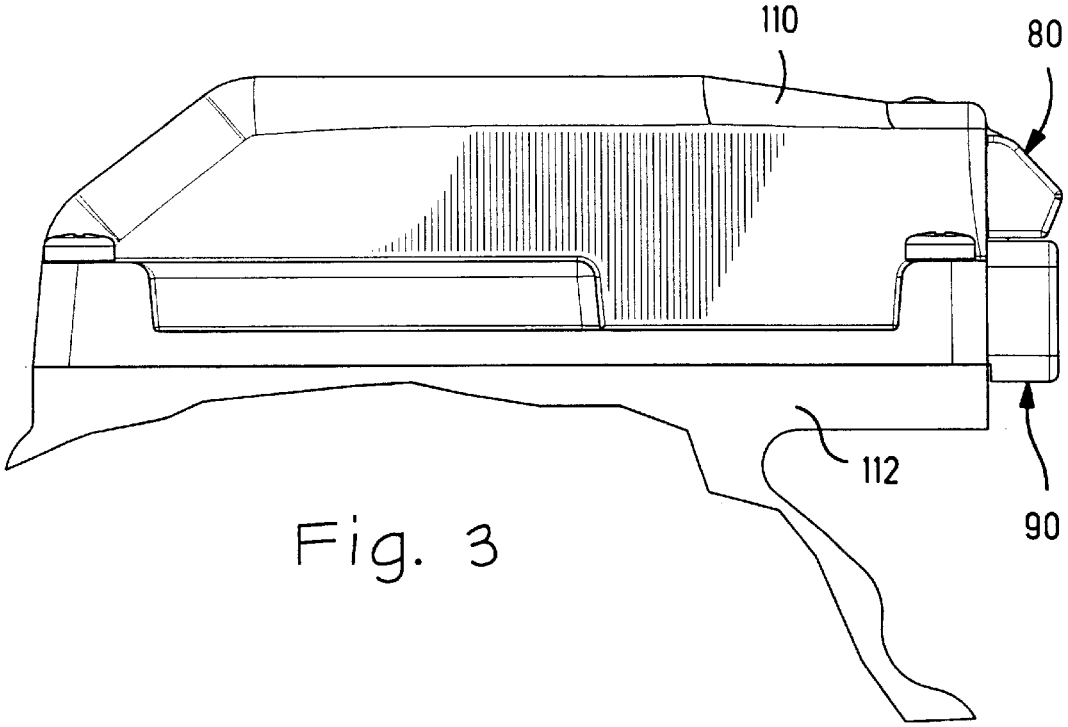
FIG. 3 is a side view of the shield mounted to the motor housing.

FIG. 1 shows an isometric view of the connector assembly 10 which is to be connected to the header connector assembly described in U.S. patent application Ser. No. 09/108,366 and shown in FIGS. 3 and 4. The electrical connector assembly 10 is mounted and secured to the header connector assembly 100 within the conductive shroud 110.

The electrical connector assembly 10 includes two of a first connector 12 which are to be terminated to flat flexible cables 16. The flat flexible cable 16 has a conductive shielding braid 17 or some type of ground layer secured thereover. The conductive shielding braid 17 is stripped in order to terminate the flat flexible cable to the first connector 12. The electrical connector assembly 10 has two of a second electrical connector 14 having power contacts therein which are secured to cable 18, shown as a power cable connector. Cable 18 has a plurality of inner conductors 21 which are surrounded by an outer conductive braid 19 or shield.

Figure 4:
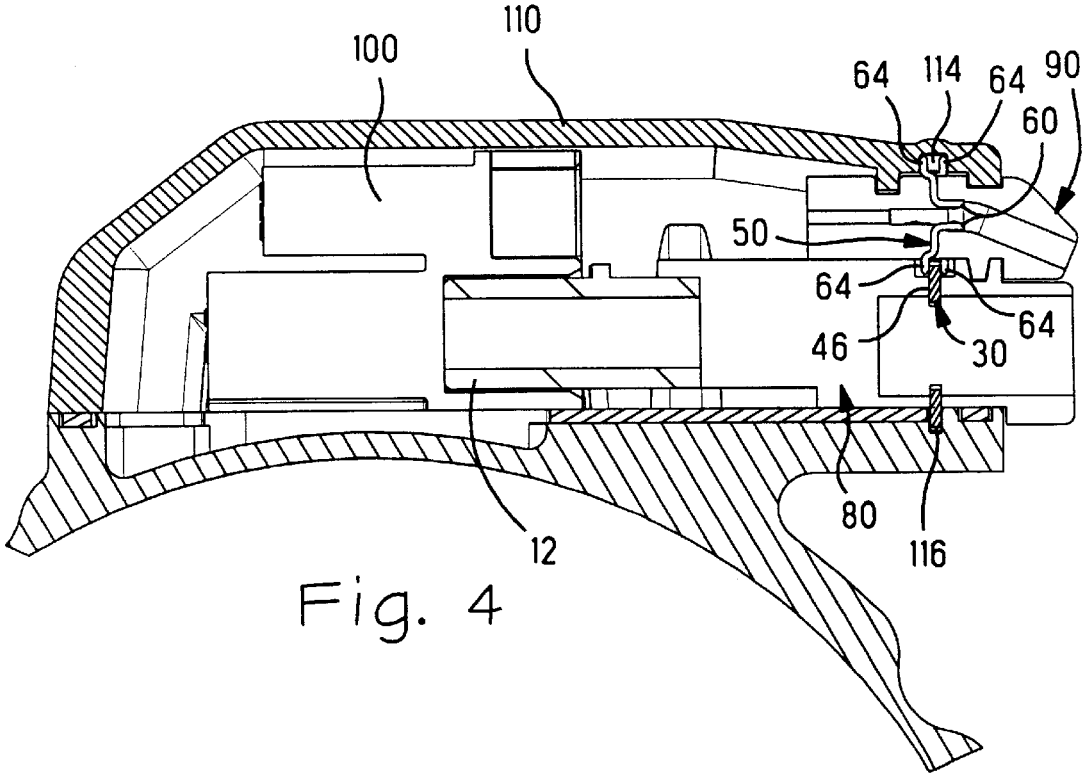
FIG. 4 is a cross-sectional view of the header connector assembly mounted onto the motor housing along with the electrical connector assembly assembled thereto.

The electrical connector assembly 10 is designed to be mated with the header connector assembly 100, FIG. 4, which is secured within the conductive shroud 110 and mounted on the motor housing 112. The header connector assembly 110 has mating sections for mating with the four electrical connectors 12, 14 within the interior of the conductive shroud 110.

The electrical connector assembly 10 further comprises grounding clips 30, 50. The grounding clips are conductive members that are used to common the outer shielding braids 17, 19 of both the flat flexible cable 16 and the power cable 18. The grounding clips 30, 50 are also used to shield the opening 118 of the conductive shroud 110. The braids are terminated to the grounding clips 30, 50, as will be described hereinafter, and the wires are then terminated to terminals within the first and second electrical connectors, 12, 14, the terminals are not shown in the drawings, but are standard terminals known in the art.

Once the shielding braids 17, 19 are terminated to the grounding clips 30, 50, the first and second electrical connectors 12, 14 are then individually overmolded. Two second connectors 14, their respective cables 18 and grounding clips 30 are overmolded to form housing 80. The first connector 12 has the grounding clip 50 and the cable 16 overmolded to form housing 90. The overmolded first and second connectors 12, 14 provide a unitary and secured assembly which can be easily assembled together for insertion into and mating with the header connector assembly 100.

Figure 2:
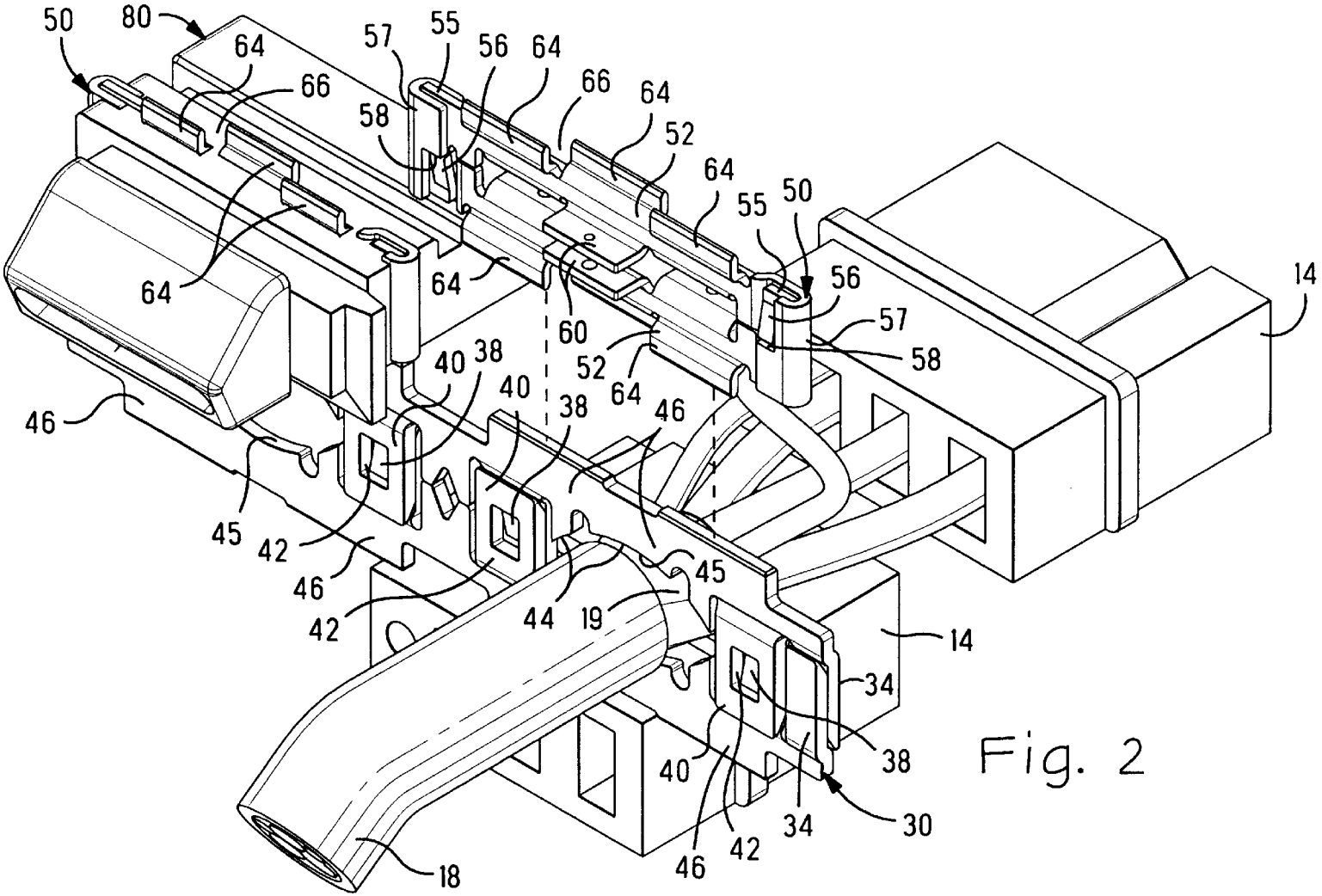
FIG. 2 is an exploded isometric view of the electrical connector assembly having the overmolding partially removed therefrom.

FIG. 2 shows portions of the overmolded housings 80, 90 removed and only electrical connectors 14 and power cable 18 to better illustrate the interactions and electrical connection of the grounding clips 30, 50 both with each other and with the grounding braid on cable 16, 18.

Figure 5:
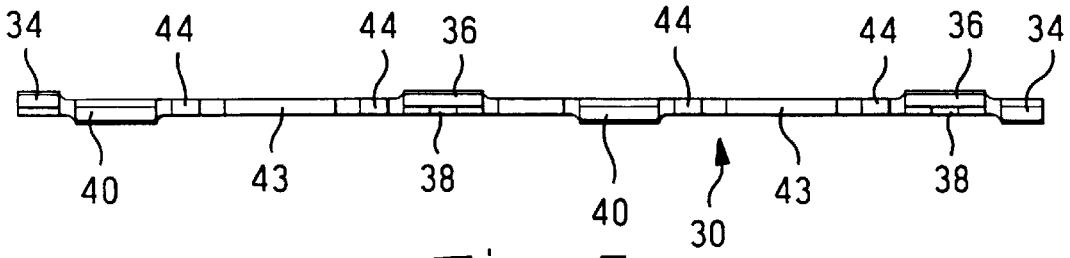
FIG. 5 is a top view of one half of one of the grounding clips.
Figure 6:
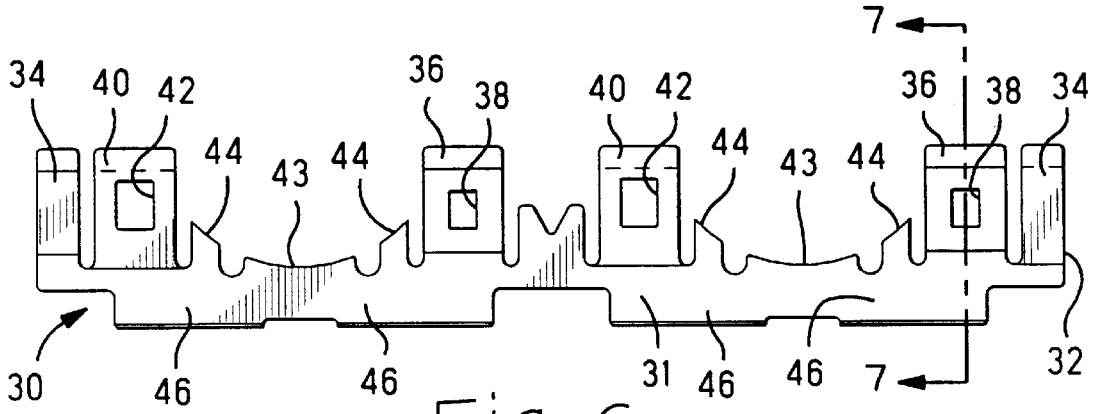
FIG. 6 is a side view of the grounding clip half of FIG. 5.
Figure 7:
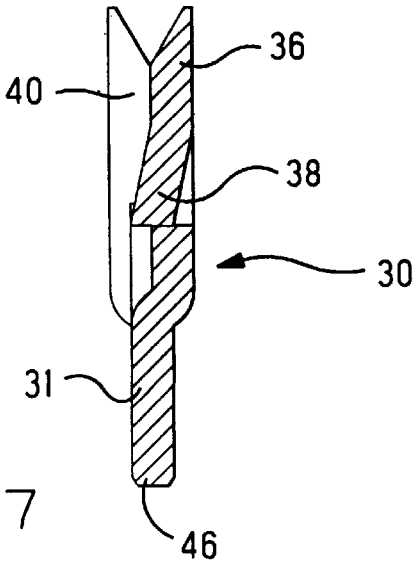
FIG. 7 is a cross-sectional view of the grounding clip half taken along line 7—7 of FIG. 6.
Figure 8:
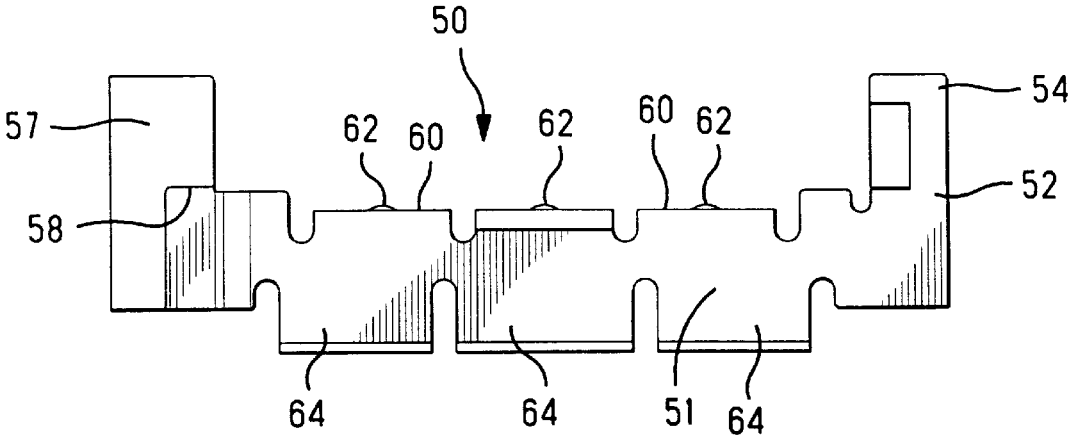
FIG. 8 is a side view of one half of an alternative embodiment of the grounding clip.
Figure 9:
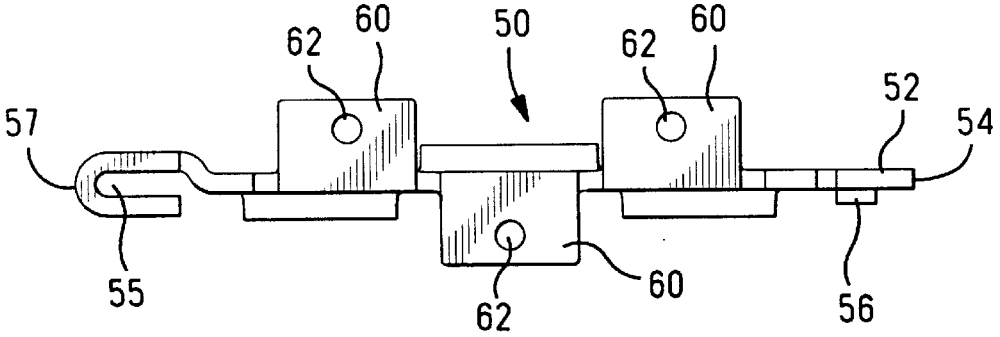
FIG. 9 is a top view of the grounding clip half of FIG. 8.
Figure 10:
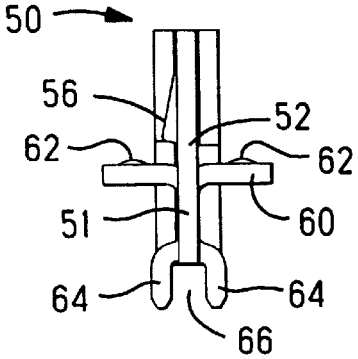
FIG. 10 is end view of the grounding clip half of FIG. 8.
Figure 11:
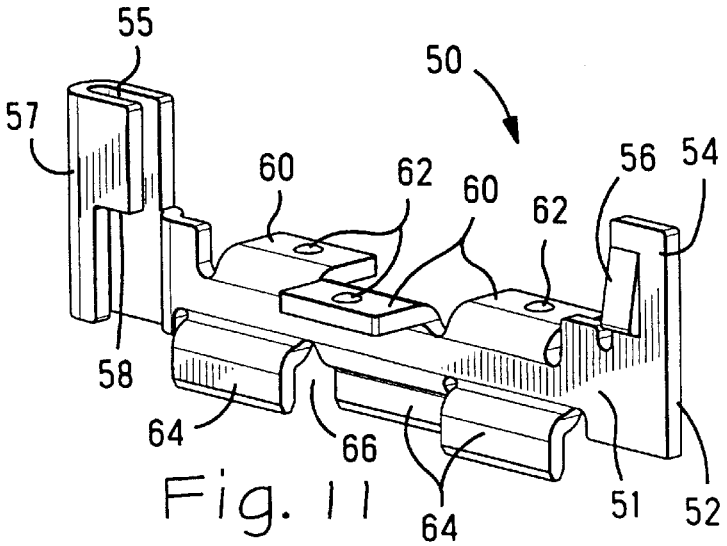
FIG. 11 is an isometric view of the grounding clip half of FIG. 8.

The grounding clip 30 is shown in FIGS. 5, 6, and 7. Grounding clip 30 is formed by taking two hermaphroditic halves 32 and assembling them together as is shown in FIG. 2. The grounding clip 30 has a conductive member having an essentially planar main body or first section 31 including first and second sections. Each of the hermaphroditic halves has stabilizing fingers 34 along either end thereof, the stabilizing fingers 34 extend from the plane of the main body 31, as is shown in FIG. 5. Each hermaphroditic half 32 also has interlocking members, shown as latching arms or fingers 36 and securing arms 40. Each latching finger 36 has a resilient latch 38 in the center of the latching finger 36 The latching fingers 36 extend from the plane of the main body 31. Each hermaphroditic half 32 has securing arms 40. The securing arms 40 have latch receiving openings 42 centrally disposed. The securing arms 40 and the latching fingers 36 extend outwardly in the same direction from a common side of the main body 31 and at an acute angle with respect to each other, as best seen in FIG. 7.

When the hermaphroditic halves 32 are assembled together, the stabilizing fingers 34 will be received abutting each other as in shown in FIG. 2. Each of the latching fingers 36 will be received against a securing arm 40 and the resilient latch 38 will be received within latch receiving openings 42 thereby latching and securing one half to the other. Each of the fingers 36 and securing arm 40 will engage a complementary securing arm 40 and latching finger 36 on the other hermaphroditic half to secure the two hermaphroditic halves 32 together.

Each hermaphroditic half 32 has a shielding braid receiving area 43 having electrical connecting or grounding tabs 44 which form a generally arcuate surface for engaging the shielding braid 19. When the two hermaphroditic halves 32 are assembled together, as shown in FIG. 2, the braid receiving areas 43 or first section of body 31 form a first cable receiving opening 45 within the grounding clip 30 which will receive the cable 18 therethrough and engage the conductive shielding braid 19. The hermaphroditic half 32 has electrical engagement sections 46 disposed along one side thereof defining the second section of body 31. The electrical engagement areas 46 are straight sections or straight tab sections and are used to engage conductive portions of adjacent articles or structures, such as grounding clips or shrouds.

FIGS. 8–11 show the grounding clip 50 which is to be used to electrically connect the conductive shielding braid 17 of the flat flexible cables 16. The grounding clip 50 is comprised of two hermaphroditic halves 52 that are secured together to form the grounding clip 50. The hermaphroditic half has a generally planar main body or first section 51 having first and second sections. Each of the hermaphroditic halves has interlocking members shown as an end arm or tab 54 having a resilient finger 56 thereon and slotted arm or end 57. The end tab 54 extends out of the plane of the main body 51. On the opposite end of hermaphroditic half 52 is a slotted end 57 having a slot 55 and a latching surface 58 thereon. The hermaphroditic half 52 has grounding or electrical engagement fingers 60 with contact burps 62 thereon to provide electrical connection with the shielding braid 17. The hermaphroditic halves 52 have tabs 64 extending from one end, the tabs 64 form a tab receiving slot 66 therebetween defining a second section.

When two hermaphroditic halves 52 are assembled together, as shown in FIG. 2, securing tab 54 of the one half is received within slot 55 of the slotted end 57 of the other half and resilient finger 56 engages the corresponding latching surface 58 on the associated slotted end 57 thereby securing the two halves 52 together to form the grounding clip 50. Electrical engagement of the electrical engagement or grounding fingers 60 on the two hermaphroditic halves 52 form a second cable receiving opening 68 through which the flexible cable 16 will be received and about which the conductive shielding braid 17 will be secured to the grounding clip 50. The opening 68 between fingers 60 is more elongated then first cable receiving opening 45 of grounding clip 30 to provide a good electrical connection with the flatter, and wider, flat flexible cable 16

When they are completely secured, grounding clip 50 can be electrically connected to grounding clip 30 by slipping the electrical engagement sections 46 into the slot 66 thereby securing grounding clip 50 to grounding clip 30 and also electrically connecting the two clips together. The interaction between the electrical engagement sections 46 and the slot 66 is an interference fit to provide a good electrical connection between the grounding clips 30, 50.

Electrical connector assembly 10 is first prepared by taking the outer shielding braid 19 off the power cable 18 and stripping it off the individual insulated conductors so that the individual conductors can be inserted within second electrical connector 14 and terminated to terminals therein, not shown. The grounding clip 30 would be secured around two power cables 18 simultaneously thereby contacting the shielding braid 19 of both of those cables. Once the cables have been terminated to the second electrical connectors 14 and secured within the grounding clips 30, the assembly is then overmolded to provide housing 80 and to provide a unitary assembly of two second electrical connectors 14, the power cables 18 along with the individual conductors, and the grounding clip 30. The electrical engagement sections 46 of the grounding clip 30 will extend out of the top and the bottom of the overmolded housing 80 thereby allowing electrical contact with the grounding clip 30, see FIG. 4.

Next, the shielding braid 17 on the flat flexible cable 16 is stripped off so the flat flexible cable 16 can be terminated to terminals within the first connector 12, not shown. The grounding clip 50 is then assembled around the flat flexible cable 16 providing an electrical connection to the folded back shielding braid 17. The grounding clip 50 along with the shielding braid 17 and the flat flexible cable 16 are then overmolded to get overmolded housing 90. The commoning areas or tabs 64 on the grounding clip 50 are exposed above and below the over-molded housing 90 to provide access to the slot 66 so that the grounding clip 30 can be commoned with other ground clips or a shroud. The overmolded housing 90 is then stacked on top of the overmolded housing 80 so that the commoning area 46 on grounding clip 30 are received with the slot 66 on grounding clip 50 thereby providing an electrical connection between the grounding clips 30, 50. As shown in FIG. 1, a second overmolded housing 90 having an associated grounding clip 50, is secured on top of grounding clip 30 and electrically connected thereto.

Electrical connector assembly 10 can then be mated with the housing of header connector assembly 100 within the conductive shroud 110. This is partially shown in FIG. 4. The overmolded housings 80, 90 are received within the shroud opening 118 of the conductive shroud 110. The conductive shroud 110 has a slot 114 disposed along an upper portion thereof and another slot 116 is disposed along the surface of the motor housing 112. The electrical engagement areas 46 from grounding clip 30 are received within the slot 116. As can be seen from the cross-sectional view, the upper electrical engagement areas 46 are received within the slot 66 on the overmolded housing 90. The electrical connection sections or tabs 64 of grounding clip 50 are then received within slot 114 from the conductive shroud 110. When the electrical connector assembly 10 is mated with the housing of header connector assembly 100 and secured within the opening 118 of the conductive shroud 110, the opening 118 is completely electrically sealed by the use of the grounding clips 30, 50. The conductive shroud 110, the ground clips 30, 50, and the motor housing 112 are all electrically connected together to provide a good ground for the shielded connectors and for the shroud opening 118.

While the grounding clip 30 is shown designed for use with two cables, it is to be understood that it could be designed either for use with one cable or for more than two cables. Also the grounding clips 30, 50 are shown having only one stacked on top of the other, however, it is to be understood that multiple grounding clips could be stacked on top of each other by alternating grounding clip 30 and grounding clip 50. Furthermore, while the grounding clips are shown designed to terminate alternating power and flexible cable for signals, it could also be designed to provide the same grounding for the same type of cable.

It is felt that the electrical connector and the grounding clips of the present invention and many of their attendant advantages will be understood from the foregoing description. It is apparent that various changes may be made in the form, construction, and arrangement of parts thereof without departing from the spirit or scope of the invention, or sacrificing all of its material advantages.

What is claimed is:

1. A grounding clip for an opening in an enclosure, comprising:

a conductive member having two halves for providing an electrical connection between shielding of a shielded cable and a conductive portion of an adjacent article, the conductive member having a main body including first and second sections;

the first section being substantially planar and having at least one cable receiving opening extending therethrough, the opening being in electrical engagement with the shielding of the cable and providing electrical connection between the shielding and the conductive member;

the second section being adapted to be electrically connected to the conductive portion of the adjacent article; and each half including interlocking members that engage cooperating members on the other half upon the halves being brought together and into electrical engagement with the shielding of the cable.

2. The grounding clip of claim 1, wherein the two halves are identical to each other.

3. The grounding clip of claim 1, wherein the second section comprises a plurality of tabs extending straight outwardly from edges of the planar first portion.

4. The grounding clip of claim 1, wherein second section comprises a plurality of bent tabs extending outwardly from edges of the planar first portion with adjacent tabs being bent in opposite directions to form a slot therebetween.

5. The grounding clip of claim 1, wherein the first section of the conductive member has at least two cable receiving openings through which two individual cables are received.

6. The grounding clip of claim 1, wherein the first section of the conductive member and the shielded cable are overmolded so that the second sections are exposed at a surface of the overmolding, such that the grounding clip provides shielding within the opening and the overmolding provides sealing within the opening.

7. A grounding clip, comprising:

two halves to be secured together and in electrical engagement around a shielded cable, each half including a body portion having first and second sections, the first section being a planar portion adapted to form at least one opening therethrough upon the halves being secured together, each half including interlocking members that engage cooperating members on the other half upon the halves being brought together and into electrical engagement with the shielding of the cable;

the second section of each of the halves having an electrical engagement section disposed along one side thereof to provide electrical engagement to an adjacent article along a top and a bottom of the assembled grounding clip.

8. The grounding clip of claim 7, wherein the two halves are identical to each other.

9. The grounding clip of claim 7, wherein the electrical engagement section is a plurality of tabs that extend straight outwardly from a main body of the grounding clip.

10. The grounding clip of claim 7, wherein the electrical engagement section is a plurality of bent tabs that extend outwardly from edges of the firs portion with adjacent tabs being bent in opposite directions to form a slot therebetween.

11. The grounding clip of claim 8, wherein the interlocking members for each of the halves are cooperating latching arms and securing arms, such that upon securing the halves together, the latching arms on one of the halves engage respective ones of the cooperating securing arms on the other of the halves.

12. The grounding clip of claim 11, wherein one end of each latching arm has a resilient latch thereon and the other end has a latching portion defining a slot adapted to receive the latch therein, such that upon inserting the latch of one half into the slot of the other half, the halves are secured together.

13. The grounding clip of claim 11, wherein the latching arm has a resilient latch thereon and the securing arm has an opening therein, the resilient latch engaging the opening to secure the halves together.

14. An electrical connector assembly, comprising:

a connector housing for terminating wires from a shielded cable;

a grounding clip for providing an electrical connection between shielding from a shielded cable and a conductive portion of an adjacent article, the grounding clip being a conductive member formed from two halves and having a main body including first and second sections, the first section being substantially planar and having a cable receiving opening extending therethrough for establishing electrical connection with the shielding, the opening further including a plurality of ground tabs for electrically engaging the shielding and a second section including a plurality of electrical engagement tabs to provide electrical engagement with an adjacent structure, each half including interlocking members that engage cooperating members on the other half upon the halves being brought together and into electrical engagement with the shielding of the cable.

15. The electrical connector assembly of claim 14, wherein the two halves are identical to each other.

16. The electrical connector assembly of claim 14, wherein the electrical engagement tabs extend straight upwardly from a main body of the grounding clip.

17. The electrical connector assembly of claim 14, wherein the electrical engagement tabs are bent with adjacent electrical engagement tabs extending in opposite directions to form a slot therebetween.

18. The electrical connector assembly of claim 14, wherein the assembly comprises at least two connector housings, at least one stacked on top of at least one other and at least two grounding clips for two of the cables, one of the grounding clips having electrical engagement tabs that extend straight upwardly from a main body of the grounding clip, the other of the grounding clips having electrical engagement tabs that are bent with adjacent electrical engagement tabs extending in opposite directions to form a slot therebetween the electrical engagement tabs that extend straight being received into the slot between the bent electrical engagement tabs to electrically engage the grounding clips.

19. An electrical connector assembly, comprising:

a connector housing for terminating wires from a shielded cable;

a cable having shielding therearound;

a grounding clip for electrically connecting the shielding from the cable to a conductive portion of an adjacent article, the grounding clip being a conductive member formed of two halves and having first and second sections, the first section being substantially planar and having an opening through which the cable extends with tabs therein to provide electrical connection to the shielding of the cable and the second section having electrical engagement tabs to provide engagement with an adjacent structure;

each half including interlocking members that engage cooperating members on the other half upon the halves being brought together and into electrical engagement with the shielding of the cable; and an overmolded housing molded over the cable and the grounding clip, wherein the electrical engagement tabs are exposed above and below the overmolded housing.

20. The electrical connector assembly of claim 19, wherein the two halves are identical to each other.

21. The electrical connector assembly of claim 19, wherein the electrical engagement tabs extend straight upwardly from a main body of the grounding clip.

22. The electrical connector assembly of claim 19, wherein the electrical engagement tabs are bent, adjacent electrical engagement tabs extend in opposite directions to form a slot therebetween.

23. The electrical connector assembly of claim 19, wherein the assembly comprises two connector housings, one stacked on top of the other and two grounding clips for two of the cables, one of the grounding clips having electrical connection tabs that extend straight and upwardly from a main body of the grounding clip, the other of the grounding clips having electrical engagement tabs that are bent with adjacent electrical engagement tabs extend in opposite directions to form a slot therebetween the electrical engagement tabs that extend straight are received into the slot between the bent electrical engagement tabs to electrically connect the grounding clips.

24. The grounding clip of claim 1, wherein the interlocking members of the halves are cooperating latching arms and securing arms, such that upon securing the halves together, the latching arms on one of the halves engage respective ones of the cooperating securing arms on the other of the halves.

25. The electrical connector assembly of claim 14, wherein the interlocking members of the halves are cooperating latching arms and securing arms, such that upon securing the halves together, the latching arms on one of the halves engage respective ones of the cooperating securing arms on the other of the halves.

26. The electrical connector assembly of claim 19, wherein the interlocking members of the halves are cooperating latching arms and securing arms, such that upon securing the halves together, the latching arms on one of the halves engage respective ones of the cooperating securing arms on the other of the halves.

* * * * *